US009524704B2

(12) United States Patent
McSwain

(10) Patent No.: US 9,524,704 B2
(45) Date of Patent: Dec. 20, 2016

(54) STRINGED INSTRUMENT WITH FINGERBOARD SUPPORT

(71) Applicant: Stephen McSwain, Valley Village, CA (US)

(72) Inventor: Stephen McSwain, Valley Village, CA (US)

( * ) Notice: Subject to any disclaimer, the term of this patent is extended or adjusted under 35 U.S.C. 154(b) by 307 days.

(21) Appl. No.: 14/268,370

(22) Filed: May 2, 2014

(65) Prior Publication Data

US 2015/0317958 A1 Nov. 5, 2015

(51) Int. Cl.
*G10D 3/06* (2006.01)

(52) U.S. Cl.
CPC ..... *G10D 3/06* (2013.01)

(58) Field of Classification Search
CPC ..... G10D 3/06; G10D 1/00; G10D 1/005; G10D 3/00; G10H 2220/051; G10H 1/342; A63F 13/245; A63F 2300/1043; A63F 2300/1062; A63F 13/02; A63F 13/40; A63F 13/06
USPC ..... 84/267, 290, 293
See application file for complete search history.

(56) References Cited

U.S. PATENT DOCUMENTS 6,965,066 B1 * 11/2005 Lace ..... G10D 3/06 84/293
2014/0157968 A1 * 6/2014 Kunstadt ..... G10D 3/06 84/293

OTHER PUBLICATIONS

Electric Guitar Company, <http://www.electricalguitarcompany.com/>, Access Date: Apr. 4, 2014, 3 pages.
Kramer Aluminum Neck Guitars, <http://www.vintagekramer.com/alum.htm>, Access date: Apr. 4, 2014, 6 pages.

* cited by examiner

*Primary Examiner* — Kimberly Lockett
(74) *Attorney, Agent, or Firm* — Alleman Hall McCoy Russell & Tuttle LLP

(57) ABSTRACT

Embodiments are disclosed that relate a stringed instrument having a fingerboard support disposed between a fingerboard and a neck base. For example, one disclosed embodiment comprises a body, and a neck structure extending from the body, the neck structure comprising a neck base, a fingerboard support coupled with the neck base, and a fingerboard coupled with the fingerboard support, wherein the fingerboard support comprises a support surface configured to contact an underside of the fingerboard and a raised side that at least partially covers a lateral side of the fingerboard.

19 Claims, 3 Drawing Sheets

STRINGED INSTRUMENT WITH FINGERBOARD SUPPORT

BACKGROUND

Many stringed instruments include a body, a neck extending from the body, and strings that extend along the neck to the body. Examples of such instruments include, but are not limited to, guitars, bass guitars, mandolins, banjos and other plucked instruments, as well as violins, cellos, basses, and other bowed instruments. The neck of a stringed instrument may include a fingerboard bonded to a neck base. The fingerboard may be formed from a long, thin strip of a different wood (e.g. ebony) than the neck base, and may or may not include frets. Further, some necks may include a binding material arranged along an outer edge of the fingerboard as a decorative and protective feature.

SUMMARY

Embodiments are disclosed that relate to a stringed instrument having a fingerboard support disposed between a fingerboard and a neck base. For example, one disclosed embodiment comprises a body, and a neck structure extending from the body, the neck structure comprising a neck base, a fingerboard support coupled with the neck base, and a fingerboard coupled with the fingerboard support, wherein the fingerboard support comprises a support surface configured to contact an underside of the fingerboard and a raised side that at least partially covers a lateral side of the fingerboard.

Another disclosed embodiment provides a stringed instrument comprising a body, and a neck structure extending from the body, the neck structure comprising a neck base, a fingerboard coupled to the neck base, a truss rod, and a fingerboard support disposed between the neck base and the fingerboard, the fingerboard support extending at least partially a length of the neck base and the fingerboard.

Another disclosed embodiment provides a stringed instrument comprising a body, and a neck structure extending from the body, the neck structure comprising a neck base, and a fingerboard removably coupled to the neck base such that the fingerboard is interchangeable.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
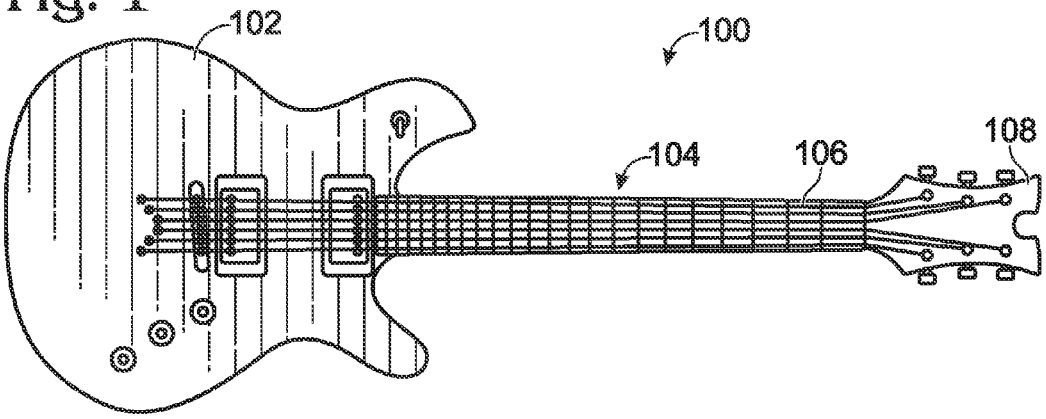
FIG. 1 shows an example stringed instrument.

As mentioned above, a stringed instrument, such as a guitar, bass guitar, banjo, or mandolin, may include a fingerboard laminated to a neck base. FIG. 1 shows an example guitar 100, and illustrates a body 102 and a neck 104. Strings 106 extend from an optional headstock 108 along a length of the fingerboard 104 to the body 102.

A neck 102 may include a neck base and a fingerboard. The neck base may be formed from one or more pieces of wood that are formed into a curved shape configured to accommodate a curve of a human hand. The fingerboard may be made from a thin strip of wood, and may have a slight arch profile from side to side. Frets may or may not be attached to the fingerboard.

Additionally, a binding may be attached to an outer edge of the fingerboard on some instruments. For example, guitar binding materials are typically formed from long, thin strips of a plastic material having a rectangular cross section. In a neck with a binding around the fingerboard, the fingerboard may have a narrower width than the surface of the neck base to which the fingerboard is attached to accommodate the extra width of the binding material. The binding is attached by laminating the binding to desired locations of the outer edge of the fingerboard and neck base, and then shaping the binding to smooth the transitions between the fingerboard, binding, and edge of the neck, as well as any joints between sections of binding.

The thin profiles of binding materials and the techniques used to apply binding materials to a guitar may make it difficult to use materials that tend to crease or break when bent, such as various metallic materials. This is because strips of such materials suitable for use as binding may be prone to bending, kinking, breaking, and other problems when applied to a neck, and also may be difficult to adhere to the wood materials of the neck.

Figure 2:
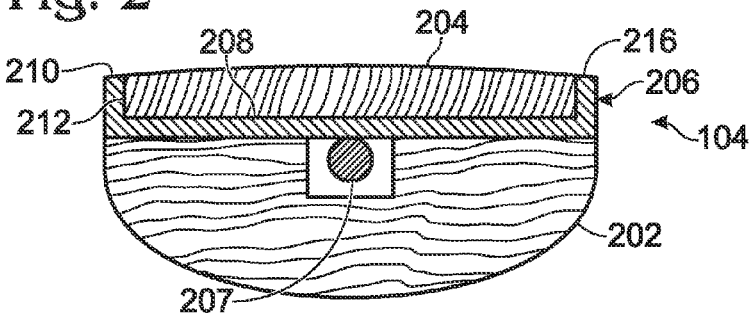
FIG. 2 shows a sectional view of an example of a stringed instrument neck.

Accordingly, embodiments are disclosed herein that relate to stringed instruments having neck assemblies that may address such problems, and provide other advantageous features. FIG. 2 shows a cross section of the neck 102 (shown separately from the body 104) that comprises a neck base 202, a fingerboard 204, and a fingerboard support 206 located between the neck base 202 and the fingerboard 204. The neck 200 is also depicted as including a truss rod 207 beneath the fingerboard support, wherein the truss rod may be adjusted to control an end-to-end curvature of the neck 202.

Figure 3:
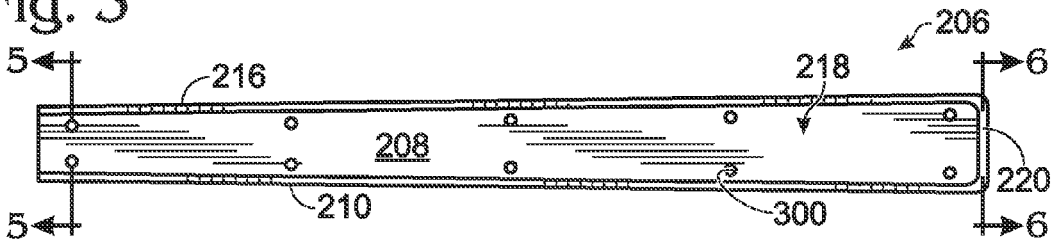
FIG. 3 shows a top view of an example fingerboard support.
Figure 4:
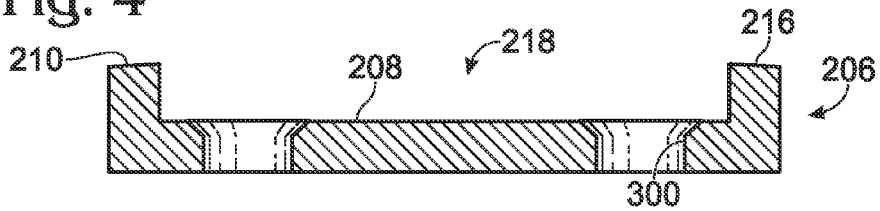
FIG. 4 shows a front view of the fingerboard support of FIG. 3.
Figure 5:
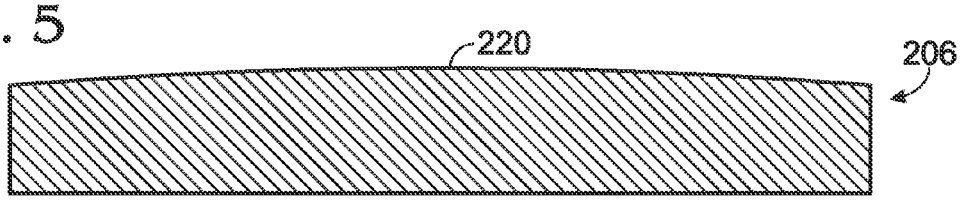
FIG. 5 shows a back view of the fingerboard support of FIG. 3.

FIGS. 3-5 show the fingerboard support in more detail. The fingerboard support 206 includes a support surface 208 configured to contact an underside of the fingerboard 204, and also a raised side 210 that at least partially covers a lateral side 212 of the fingerboard 204. In the depicted example, the fingerboard support includes opposing raised sides 210, 216 that define a channel 218 in which the fingerboard 204 is positioned. Further, referring to FIG. 5, the fingerboard support 206 also includes a raised edge 220 located at an end of the fingerboard support 206 adjacent to the body 202 of the guitar. The raised edge 220 at the end of the fingerboard support 206 may have a curvature that matches a curvature of a side-to-side profile of the fingerboard, such that the surface boundary between the fingerboard 204 and fingerboard support 206 is substantially continuous and flush. In other examples, the raised edge of the fingerboard support may have any other suitable configuration.

The depicted fingerboard support 206 has a monolithic, single piece construction that may be structurally robust. Further, the raised edges 210, 216 and 220 may appear substantially similar to traditional neck binding to an observer, as the portion of the fingerboard support 206 that is located between the fingerboard 204 and the neck base 202 is hidden from view. Thus, the fingerboard support 206 may be used to form decorative fingerboard edging from materials that are difficult to apply in the form of traditional guitar binding. It will be understood that, in other implementations, a fingerboard support may be provided as two or more separate pieces. For example, a fingerboard support may comprise a separate piece for each opposing side of a neck, such that each piece includes a portion located between the fingerboard and neck base, and a raised edge that extends at least partially along a lateral side of the fingerboard.

The fingerboard support 206 may be coupled to the neck base 202 in any suitable manner. For example, in some implementations the fingerboard support 206 may be coupled to the neck base with an adhesive. Alternatively or additionally, one or more fasteners may be used. FIGS. 3 and 4 depicts a plurality of holes 300 formed in the fingerboard support 206, wherein each hole is configured to accept a fastener (e.g. a screw) for fastening the fingerboard support 206 to the neck base 202. In such implementations, the holes 300 may be countersunk such that the screw heads do not extend above a bottom plane of the channel 218 when the fingerboard support 206 is attached to the neck base 202.

The use of a fingerboard support as disclosed herein may permit materials that are difficult to use as traditional guitar binding (e.g. as a thin strip of material applied to an edge of a fingerboard) to be used more easily. For example, aluminum may be a difficult material to use as a traditional guitar neck binding, as aluminum may be easily damaged when in the shape of a long, thin strip. In contrast, a fingerboard support such as that shown in FIGS. 2-5 may be machined from a larger piece of aluminum to form a rigid structure that is not easily bent. As such, the appearance of a neck binding may be achieved with less opportunity for error. Further, the depicted fingerboard support also may be easier to install than traditional neck binding, as installation may involve merely fastening and/or adhering the fingerboard support to the neck base, followed by lamination and/or other coupling of the fingerboard to the fingerboard support and any desired finish work (i.e. polishing or otherwise imparting a desired finish to the exposed portions of the fingerboard support. Additionally, the use of a fingerboard support as disclosed herein also may allow for the use of a thinner fingerboard. As fingerboards may be made from relatively expensive materials (e.g. ebony, rosewood, maple, etc.) compared to the fingerboard support, the use of the fingerboard support may offer substantial cost savings in the construction of stringed instruments. It will be understood that the use of a fingerboard support as disclosed herein allows for the use of a neck base formed from wood or other material that is potentially lighter weight than aluminum per volume, and thus may provide advantages in weight, as well as feel and aesthetics, compared to the use of a neck made from a piece of metal (e.g. a solid aluminum piece) as a neck base plus a fingerboard.

It will be understood that a fingerboard support as disclosed herein may be made from any suitable material, including but not limited to metallic materials. Other examples of suitable materials may include non-metallic materials such as composite materials, ceramic materials, polymeric materials, etc.

Materials from which to form a fingerboard support further may be selected for tonal qualities that the materials impart to an instrument. For example, the use of an aluminum fingerboard support in an electric guitar may provide for greater sustain of tones compared to traditional guitar necks. Different metals, ceramics, composites, etc. of different thicknesses each may offer different tonal aspects, and which may vary from instrument to instrument for any given material. Thus, the use of a fingerboard support as disclosed herein may provide a mechanism to tune the tonal qualities of an instrument. In some examples, as described in more detail below, a fingerboard support may even be configured to be interchangeable, thereby allowing a user to vary the tonal qualities of an instrument as often as desired.

Figure 6:
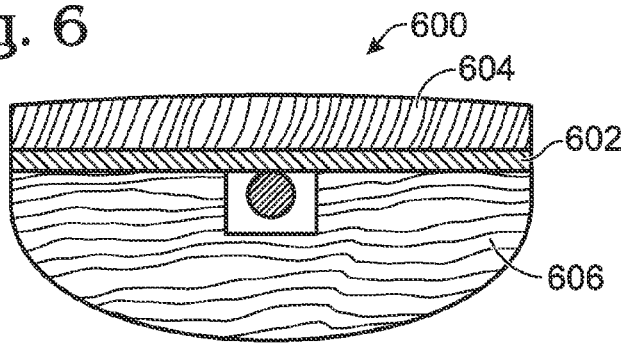
FIG. 6 shows a sectional view of another example of a stringed instrument neck.

In the example of FIGS. 2-5, the fingerboard support has a width that exceeds a width of the fingerboard, and raised sides that extend upwardly along the lateral sides and end side of the fingerboard. In other examples, the fingerboard support may have any other suitable width. For example, FIG. 6 shows an example of a guitar neck 600 (shown separately from a body for clarity) in which a fingerboard support 602 has substantially a same width as a fingerboard 604, and lacks the upturned sides of the example of FIGS. 2-5. The fingerboard support 604 in this example takes the form of a rigid plate that runs at least partially the length of the neck base 606 and fingerboard 604, and may run the full length of one or both of these structures. In such an example, the fingerboard support may appear as a stripe along each side of a neck, and thus offer a different decorative look than traditional guitar neck binding. Further, such a fingerboard support also may vary tonal qualities of a stringed instruments compared to a traditional stringed instrument neck construction.

Figure 7:
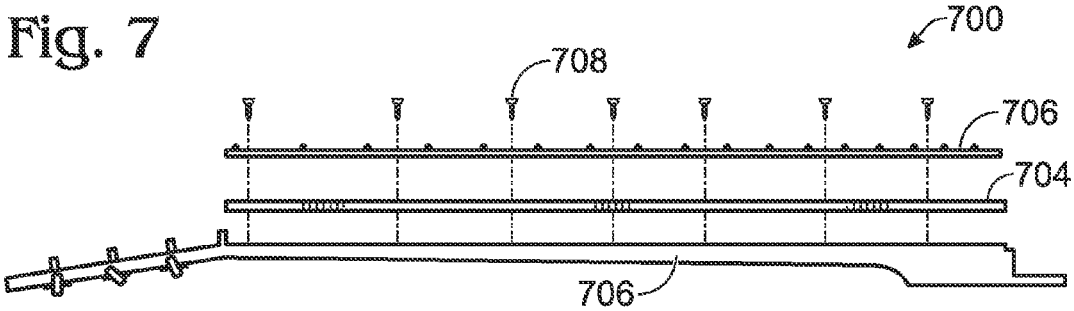
FIG. 7 shows a side exploded view of another example of a stringed instrument neck, and illustrates a removable/interchangeable fingerboard and fingerboard support.
Figure 8:
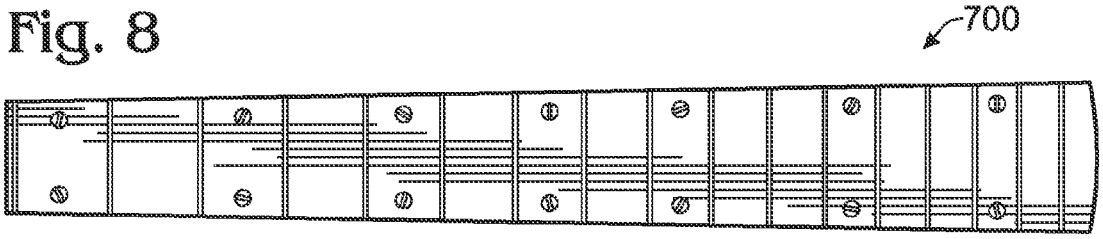
FIG. 8 shows a top view of the stringed instrument neck of FIG. 7 with the fingerboard and fingerboard support attached to a neck base.

As mentioned above, in some implementations a fingerboard support may be removably coupled to the neck of a stringed instrument. This may allow a user to use different fingerboard supports to vary the appearance and/or tonal qualities of the instrument as desired. As a more specific example, a user may wish to switch between a metallic (e.g. polished or brushed aluminum) fingerboard support and a composite (e.g. molded carbon fiber) fingerboard support for different sound and/or decorative aspects. FIGS. 7 and 8 show an example guitar neck 700 comprising a removable and interchangeable fingerboard 702, and removable and interchangeable fingerboard support 704. The depicted interchangeable fingerboard 702 and fingerboard support 704 are coupled to the neck base 706 via a plurality of fasteners 708. Fasteners 708 may be removed to change the fingerboard and/or fingerboard support, thereby allowing any desired combination of fingerboard and/or fingerboard support to be used. Any suitable mechanism may be used to removably couple the fingerboard and fingerboard support to the neck base. In the depicted example, two fasteners are located on each fret that ordinarily has a fret marker (not shown), plus two fasteners on a lowest fret (i.e. far left in FIG. 8), but any other number and placement of fasteners may be used. Likewise, other fastening mechanism than screws also may be used.

Figure 9:
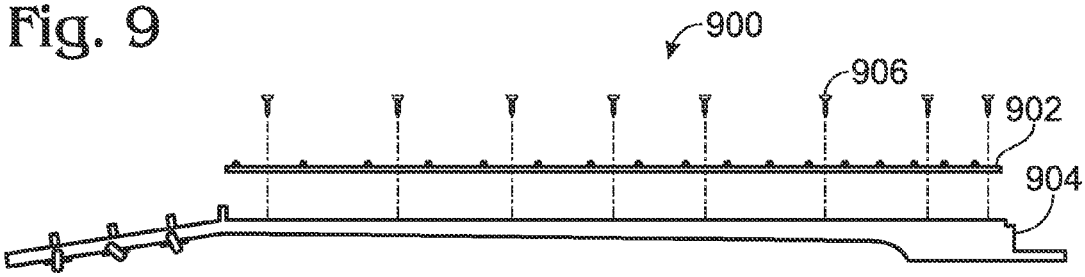
FIG. 9 shows a side exploded view of another example of a stringed instrument neck, and illustrates a removable/interchangeable fingerboard.

In some embodiments, an interchangeable fingerboard may be used without a fingerboard support, or with a non-removable fingerboard support. For example, FIG. 9 shows an example neck 900 including a fingerboard 902 removably coupled to a neck base 904 via a plurality of fasteners 906, and without a fingerboard support. This may allow a user to switch fingerboards, for example, for aesthetic and/or tonal qualities. In other embodiments, a neck may include a non-removable fingerboard support coupled to neck base, and then an interchangeable fingerboard coupled to the fingerboard support.

In the depicted examples, the fingerboard supports are configured to extend the length of a fingerboard. However, a fingerboard support may have any other suitable length. For example, a fingerboard may extend beyond a fingerboard and into a body of a stringed instrument. As a more specific example, a fingerboard support for a guitar may extend at least partially through a body, and potentially all of the way through the body. Such a configuration may be used either with a through neck instrument, a set neck instrument, or any other suitable instrument construction.

Likewise, a fingerboard support also may extend beyond a fingerboard in a direction of the headstock as well. For example, the fingerboard support may extend beyond the nut at the end of a stringed instrument fingerboard to cover at least a portion of an upper surface of the headstock as a decorative feature. In such an implementation, the nut may rest in a groove formed in the fingerboard support, or may be mounted to the fingerboard support without such a groove.

Figure 10:
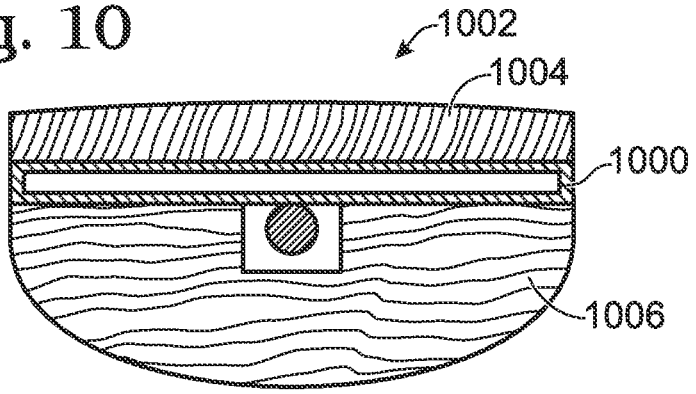
FIG. 10 shows a sectional view of another example stringed instrument neck.

In yet other implementations, a fingerboard support may have a hollow, tubular construction, rather than a solid construction. For example, referring to FIG. 10, which shows another example stringed instrument neck, a fingerboard support 1000 may take the form of a hollow structure (e.g. a hollow plate) that extends from one side of the neck 1002 to another between a fingerboard 1004 and a neck base 1006 and runs at least partially a length of the neck 1002. Such a fingerboard support may be formed from any suitable metal, including but not limited to tubular metal structures, and may have an interior cavity 1002 of any suitable dimensions. Such a hollow fingerboard support also may have upturned sides to form the appearance of neck binding, as described above.

Figure 11:
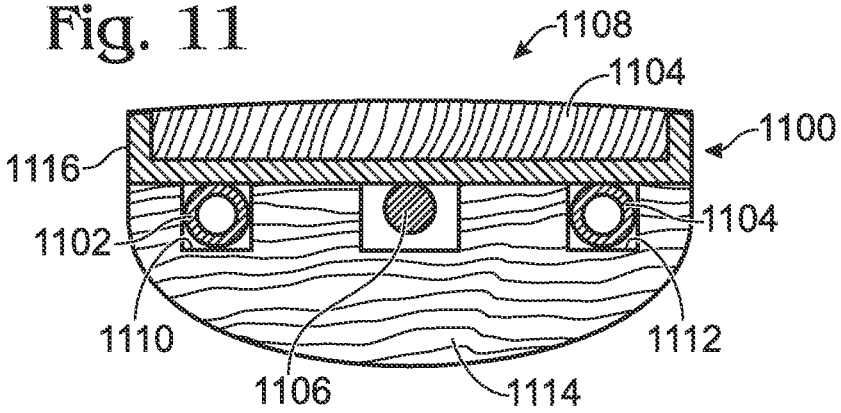
FIG. 11 shows a sectional view of another example stringed instrument neck.

As another example, FIG. 11 shows a stringed instrument neck, and illustrates an example fingerboard support as comprising one or more tubular structures coupled to the bottom of a channel-shaped fingerboard support, such as that shown in FIG. 2. The depicted fingerboard support 1100 includes two hollow tubular structures 1102, 1104 extending along each side of a truss rod 1106 of a neck 1108 and coupled to a backside of the fingerboard support 1100. The hollow tubular structures 1102, 1104 are positioned within corresponding channels 1110, 1112 formed in neck base 1114. While depicted as having a circular cross-section, the hollow tubular structures may have any other suitable cross-sectional shape. Further, while shown with upturned sides 1116, it will be understood that such sides may be omitted in other implementations. The hollow configuration of tubular structures may help to reduce a weight of neck 1108, and also may provide for different tonal characteristics than a solid wood or aluminum neck while providing the look of a predominantly wooden neck.

While the depicted examples take the form of fretted stringed instruments, it will be understood that a fingerboard support and/or interchangeable fingerboard as disclosed herein also may be used with fretless stringed instruments. It will be understood that the configurations and/or approaches described herein are presented for the purpose of example, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A stringed instrument, comprising:
a body; and
a neck structure extending from the body, the neck structure comprising
a neck base,
a fingerboard support coupled with the neck base, and
a fingerboard coupled with the fingerboard support, wherein the fingerboard support comprises a support surface configured to contact an underside of the fingerboard and a raised side that at least partially covers a lateral side of the fingerboard, and wherein the fingerboard support has a width that exceeds a width of the fingerboard.

2. The stringed instrument of claim 1, wherein the fingerboard support comprises opposing raised sides configured to at least partially cover opposing sides of the fingerboard.

3. The stringed instrument of claim 1, wherein the fingerboard support comprises a channel in which the fingerboard is positioned.

4. The stringed instrument of claim 1, wherein the raised side fully covers the lateral side of the fingerboard.

5. The stringed instrument of claim 1, wherein the fingerboard is removably coupled to the neck base.

6. The stringed instrument of claim 1, wherein the fingerboard support is formed from a metallic material.

7. The stringed instrument of claim 1, wherein the fingerboard support comprises a hollow construction.

8. The stringed instrument of claim 7, wherein the fingerboard support comprises one or more hollow tubular structures coupled to a solid plate.

9. The stringed instrument of claim 7, wherein the fingerboard support comprises a plurality of hollow tubular structures.

10. A stringed instrument, comprising:
a body; and
a neck structure extending from the body, the neck structure comprising
a neck base,
a fingerboard coupled to the neck base;
a truss rod; and
a fingerboard support disposed between the neck base and the fingerboard, the fingerboard support extending at least partially a length of the neck base and the fingerboard, wherein the fingerboard support has a raised side that at least partially covers a lateral side of the fingerboard and also has a width that exceeds a width of the fingerboard.

11. The stringed instrument of claim 10, wherein the fingerboard support comprises a channel between opposing raised sides, wherein the fingerboard is positioned in the channel and the opposing raised sides at least partially cover corresponding lateral sides of the fingerboard.

12. The stringed instrument of claim 11, wherein the fingerboard support further comprises a raised edge extending between the opposing raised sides and comprising a radius configured to match a radius of the fingerboard.

13. The stringed instrument of claim 10, wherein the fingerboard support comprises a hollow construction.

14. The stringed instrument of claim 7, wherein the fingerboard support comprises one or more hollow tubular structure coupled to a solid plate, at least one hollow tubular structures extending along each side of the truss rod.

15. The stringed instrument of claim 10, wherein the fingerboard is removably mounted to the neck base via one or more fasteners.

16. A stringed instrument, comprising:

a body; and a neck structure extending from the body, the neck structure comprising a neck base, a fingerboard removably coupled to the neck base such that the fingerboard is removable from and reattachable to the neck base, and a fingerboard support disposed between the fingerboard and the neck base, the fingerboard support comprising a support surface configured to contact an underside of the fingerboard and a raised side that at least partially covers a lateral side of the fingerboard.

17. The stringed instrument of claim 16, wherein the fingerboard is removably coupled to the neck via one or more fasteners.

18. The stringed instrument of claim 17, wherein at least one of the fasteners is a removable fret marker that extends through the fingerboard to join to the neck base when the fingerboard is attached to the neck base.

19. The stringed instrument of claim 16, further comprising a fingerboard support disposed between the fingerboard and the neck base, the fingerboard support comprising a support surface configured to contact an underside of the fingerboard and a raised side that at least partially covers a lateral side of the fingerboard.

* * * * *